US005269117A

United States Patent [19]

Boriani et al.

[11] Patent Number: 5,269,117

[45] Date of Patent: Dec. 14, 1993

[54] PRODUCT WRAPPING METHOD AND DEVICE FOR PRODUCING TUBULAR WRAPPINGS

[75] Inventors: Silvano Boriani; Antonio Gamberini, both of Bologna, Italy

[73] Assignee: G.D Societa' per Azioni, Bologna, Italy

[21] Appl. No.: 900,598

[22] Filed: Jun. 18, 1992

[30] Foreign Application Priority Data

Jun. 21, 1991 [IT] Italy ..... B091 A 000223

[51] Int. Cl.[5] ..... B65B 11/28

[52] U.S. Cl. ..... 53/234; 53/225; 53/375.9

[58] Field of Search ..... 53/225, 234, 228, 230, 53/375.9

[56] References Cited

U.S. PATENT DOCUMENTS

| | | | |
|---|---|---|---|
| 1,875,979 | 9/1932 | Beutel | 53/234 |
| 1,964,411 | 3/1934 | Beutel | 53/234 |
| 2,608,039 | 8/1952 | Abramowski | 53/234 |
| 2,714,384 | 8/1955 | Schubert | 53/234 X |
| 3,675,386 | 7/1972 | Sels | 53/63 |
| 3,813,849 | 6/1974 | Stambera | 53/234 |
| 3,911,654 | 10/1975 | Schmermund | 53/234 |
| 4,144,695 | 3/1979 | Seragnoli | 53/234 |
| 4,358,920 | 11/1982 | Lotte . | |
| 5,003,755 | 4/1991 | Draghetti | 53/234 X |

*Primary Examiner*—John Sipos

*Attorney, Agent, or Firm*—Klauber & Jackson

[57] ABSTRACT

A product wrapping method and device for producing tubular wrappings, whereby a first and second opposite longitudinal portion of a wrapping element, folded in a U about a respective product inside a respective seat on a wrapping conveyor, project outwards through the input opening of the seat, and are folded one on top of the other into an overlapping position by a folding unit, a first fixed folding device of which folds the first portion located downstream in the traveling direction of the conveyor, and a second folding device of which, fitted to the conveyor, folds the second portion down on top of the first, and holds it in this position for a given length of time. (FIG. 1 ).

8 Claims, 3 Drawing Sheets

PRODUCT WRAPPING METHOD AND DEVICE FOR PRODUCING TUBULAR WRAPPINGS

BACKGROUND OF THE INVENTION

The present invention relates to a product wrapping method for producing tubular wrappings.

In particular, the present invention relates to a method of wrapping parallelepiped products, such as packets or packs of cigarettes, to which the following description refers purely by way of example.

On cigarette wrapping, packing and cellophaning machines, a tubular wrapping is formed about the product by a wrapping device comprising a wrapping wheel conveyor having a number of equally-spaced peripheral radial seats for receiving a respective product for wrapping.

The above known wrapping device normally also comprises a loading station, and a drive device for rotating the wrapping wheel in steps about its axis in such a manner as to successively arrest the seats in the loading station where the product and respective wrapping element (sheet or blank) are loaded on to the wheel. More specifically, as each seat on the wrapping wheel is arrested at the loading station, the wrapping element is normally fed in front of the inlet opening in the seat, and the product inserted radially through the inlet opening, so as to draw the wrapping element inside the seat and fold it in a U about the product. Once the product is fully inserted inside the seat, the wrapping element presents two longitudinal portions projecting outwards of the seat, and which are subsequently folded and connected one on top of the other to complete said tubular wrapping.

On known wrapping devices of the aforementioned type, a first of the two projecting portions, the trailing or upstream one in relation to the rotation direction of the wrapping wheel, is folded first by means of a mobile external folding device fitted to the loading station and operated before the wrapping wheel is started up again; while the second projecting portion, the leading or downstream one in relation to the rotation direction of the wrapping wheel, is folded on top of the first by a fixed folding device located outwards of the wrapping wheel and which contacts the second portion as the wrapping wheel is started up again.

Said fixed folding device normally extends over a relatively wide arc about the edge of the wrapping wheel, for holding the second portion in position on top of the first pending stable connection of the second to the first portion either by gumming or, in the case of heat-sealable wrapping material, by sealing.

The above known wrapping method presents several drawbacks, mainly due to the presence of said fixed folding device. More specifically, as a consequence of said second portion, once folded down on top of the first, rubbing against the surface of the fixed folding device, this must be so positioned as to allow a certain amount of clearance between itself and the outer edge of the wrapping wheel, to prevent the second portion from being in any way damaged, which clearance, however, inevitably results in imperfect folding of the second portion and in relatively weak contact pressure between the overlapping first and second portions.

In the event, for example, of the two portions being gummed together, insufficient contact pressure may result in the second portion coming unstuck, so that the wrapped product is subsequently rejected.

In the case of heat-sealing, on the other hand, connection is normally impaired by the second portion having to be held in place by the fixed folding device during sealing.

That is, if, as is preferable, the two portions are sealed along the free edge of the second portion, the fixed folding device must normally present an opening extending over the central portion of the overlapping portion for enabling passage of the sealing device, operation of which is thus obviously limited to the length of the opening as opposed to the entire length of the overlapping portion.

Alternatively, the entire length of the overlapping portion may be sealed by arresting the wrapping wheel in such a position that the overlapping portion projects partially beyond the fixed folding device, with the free edge of the second portion held down by the end of the device. In this case, the overlapping portion is obviously sealed a given distance from the free edge of the second portion, the outer portion of which thus remains unsealed.

SUMMARY OF THE INVENTION

It is an object of the present invention to provide a method of producing tubular wrappings, designed to overcome the aforementioned drawbacks.

According to the present invention, there is provided a product wrapping method for producing tubular wrappings, said method comprising stages consisting in operating a wrapping conveyor having at least one outwardly-open wrapping seat for a respective said product in such a manner as to feed said seat in a given direction and along a path extending through a loading station wherein said product is loaded inside said seat, and through an unloading station wherein said product is unloaded from said seat; feeding a product wrapping element in front of the input opening of said seat at said loading station; feeding said product inside said seat, so as to fold said wrapping element in a U about said product, and so that a first and second longitudinal portion of said wrapping element project outwards of said seat through said inlet opening, said second longitudinal portion being located upstream in relation to said first longitudinal portion in said traveling direction; folding said portions one on top of the other into an overlapping position, and maintaining said portions in said overlapping position for a given length of time; characterized by the fact that said two portions are folded into said overlapping position by first folding said first portion on to said product, and then folding said second portion into said overlapping position on top of said first portion by means of a folding device fitted to said wrapping conveyor and moving in relation to the same to and from an operating position wherein it contacts and exerts pressure on said second portion in s id overlapping position.

Said folding device is preferably maintained in said operating position until said seat reaches said unloading station.

More specifically, according to a preferred embodiment of the above method, the folding device is so designed as to leave the free longitudinal end portion of said second portion exposed in said operating position.

The present invention also relates to a product wrapping device for producing tubular wrappings.

According to the present invention, there is provided a product wrapping device for producing tubular wrappings, said device comprising a wrapping conveyor having at least one outwardly-open wrapping seat for a respective said product, and moving in a given direction for feeding said seat along a given path; a loading station for loading said product inside said seat, and an unloading station for unloading said product from said seat, both said stations being located along said path; means for feeding a product wrapping element in front of the input opening of said seat; first pushing means for inserting said wrapping element and respective said product inside said seat, so as to fold said wrapping element in a U about said product, and so that a first and second longitudinal portion of said wrapping element project outwards of said seat through said input opening, said second longitudinal portion being located upstream in relation to said first longitudinal portion in said traveling direction; and folding means for folding said portions one on top of the other into an overlapping position, and for maintaining said portions in said overlapping position for a given length of time; characterized by the fact that said folding means comprise a folding device fitted to said wrapping conveyor and moving in relation to the same to and from an operating position wherein it contacts and exerts pressure on said second portion located outwards of said first portion in said overlapping position.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
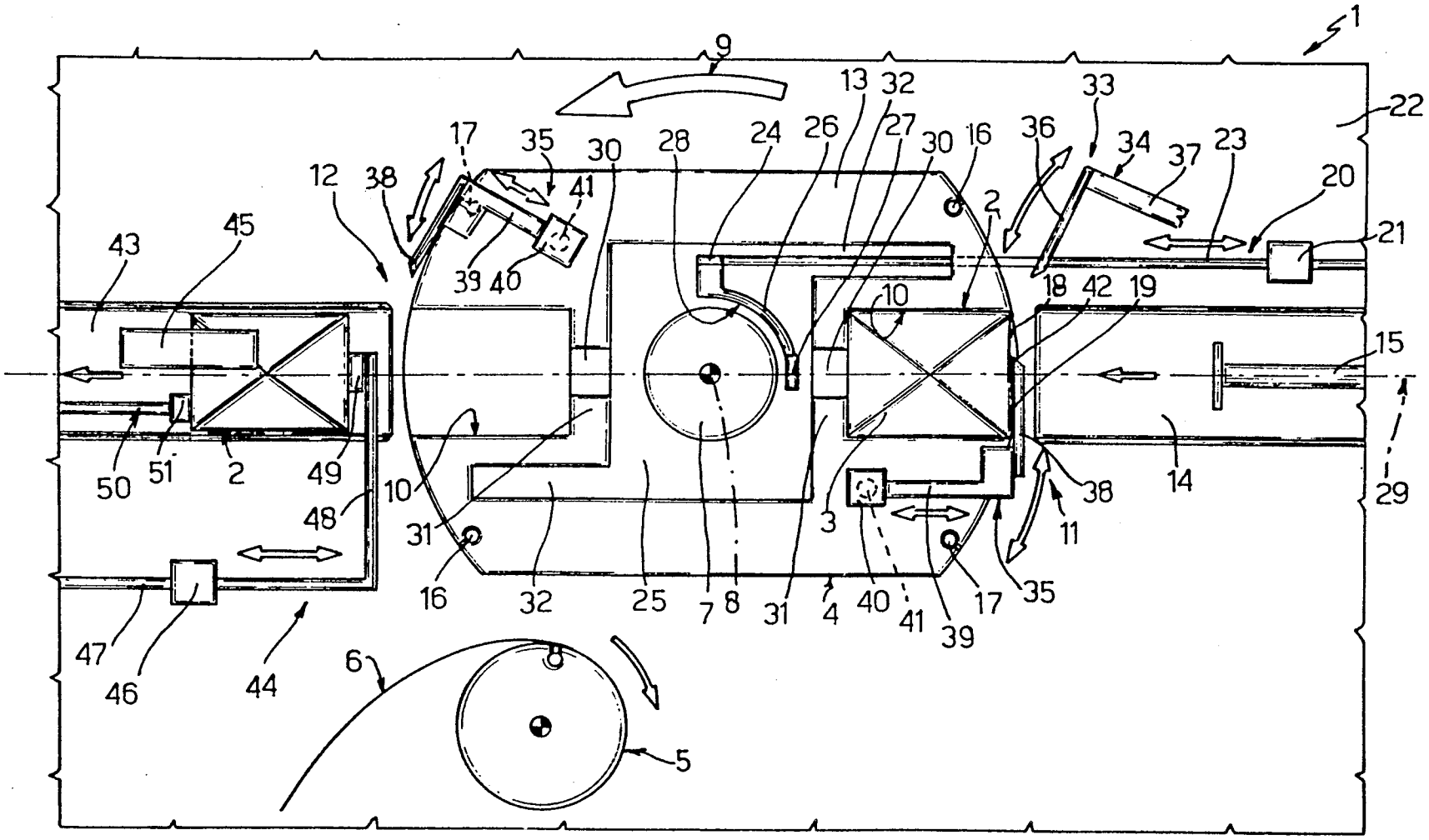
FIG. 1 shows a schematic view of a preferred embodiment of the wrapping device according to the present invention.

Number 1 in FIG. 1 indicates a wrapping device for producing tubular wrappings 2 for parallelepiped products 3 consisting, in the example shown, of packs of cigarettes.

Device 1 comprises a wrapping wheel 4 cooperating with a known rotary unit 5 for supplying sheets of wrapping material 6, and driven by a powered shaft 7 so as to rotate about its axis 8 in direction 9 (anticlockwise in FIG. 1) and so feed seats 10, equally spaced about the periphery of wheel 4, along a given path substantially tangent to supply unit 5 and extending through a loading station 11 wherein a product 3 and respective sheet 6 are inserted inside each seat 10, and through an unloading station 12 wherein product 3 and wrapping 2 are unloaded off wheel 4.

In the example shown, wheel 4, consisting of a wrapping wheel for packs of cigarettes, comprises a substantially circular plate 13 connected angularly in known manner (not shown) to shaft 7, and having two diametrically-opposed seats 10, which are fed in 180° steps between stations 11 and 12, also diametrically opposed in relation to wheel 4, and past supply unit 5 located between stations 12 and 11 in direction 9.

Loading station 11 comprises a feed channel 14 coplanar with plate 13, extending radially in relation to axis 8, and located in line with seat 10 in loading station 11.

Loading station 11 also comprises a pusher 15 for successively feeding products 3 along channel 14 and into seat 10 in loading station 11.

As it is transferred from channel 14 into seat 10, each product 3 encounters a respective sheet of wrapping material 6 fed beforehand in known manner on to wheel 4 by unit 5 and held on to the outer edge of plate 13, across seat 10, by two suction holes 16 and 17 on either side of seat 10. As product 3 is inserted inside seat 10 by pusher 15, sheet 6 is thus also inserted and folded in a U about product 3, so as to present a first and second longitudinal portion 18 and 19 projecting from seat 10 and located respectively upstream and downstream in relation to direction 9.

Loading station 11 also comprises a counterpusher 20 in turn comprising a linear actuator 21 supported on a plate 22 perpendicular to axis 8 and also supporting shaft 7 and channel 14. Actuator 21 presents an output rod 23 extending parallel to channel 14 between plates 13 and 22, and fitted on its free end with a crosspiece 24 parallel to axis 8 and extending, perpendicular to plate 22, along a central passage 25 formed through plate 13 perpendicular to plate 22 and coaxial with axis 8. Crosspiece 24 comes out of the opposite end of passage 25 to that facing plate 22, and is fitted on its free end with a curved appendix 26 extending over an arc of roughly 90° and in turn fitted on its free end with a second crosspiece 27 extending perpendicularly towards plate 22 and parallel to crosspiece 24. Crosspiece 27 together with crosspiece 24 and appendix 26 form a substantially U-shaped element 28 having its concave side facing plate 22 and integral with the free end of rod 23.

As shown in FIG. 1, central passage 25 presents a substantially square section, the sides of which are over twice as long as the distance between rod 23 and the longitudinal axis 29 of channel 14, and communicates with each seat 10 through an axial opening 30 formed in the end wall 31 of seat 10 and wider than crosspiece 27.

Finally, central passage 25 presents two parallel elongated lateral recesses 32 extending on either side of central passage 25 and each assigned to a respective seat 10. More specifically, as shown in FIG. 1, rod 23, element 28 and recesses 32 are so arranged that, when one of seats 10 is arrested in loading station 11, respective recess 32 is located parallel to axis 29, downstream from station 11 in direction 9, and facing rod 23, while respective crosspiece 27 intersects axis 29 and is aligned with respective opening 30.

When seat 10 is arrested in loading station 11, the above structural characteristics enable rod 23 to be moved between an extracted idle position (FIG. 1) wherein crosspiece 27 is located inside central passage 25, facing respective opening 30, and a withdrawn operating position (FIG. 2) wherein crosspiece 27, by moving through opening 30 and radially through seat 10, is located just outwards of the outer edge of plate 13.

Device 1 comprises a folding assembly 33 defined by a first folding device 34, hereinafter referred to as the "fixed folding device", and two folding devices 35, hereinafter referred to as "mobile folding devices". Fixed folding device 34 is assigned to loading station 11, and pivots in a fixed position on plate 22, outwards of wheel 4, for folding first portion 18 of sheet 6 on to respective product 3 in loading station 11. Each of mobile folding devices 35 is assigned to a respective seat 10, is mounted on wheel 4 so as to rotate with the same about axis 8, is located laterally in relation to respective seat 10, on the same side as second portion 19 of sheet 6, and provides for folding second portion 19 on top of first portion 18, and for maintaining portions 18 and 19 in said overlapping position for a given length of time.

Fixed folding device 34 comprises a folding plate 36 fitted squarely to the end of a rod 37 connected to plate 22 so as to rotate, in relation to the same, about an axis (not shown) parallel to axis 8, and between an idle position wherein plate 36 is located outwards of station 11, and an operating position wherein plate 36 is located tangent to wheel 4, perpendicular to axis 29, and between the end of channel 14 and the edge of wheel 4, so as to engage portion 18 of sheet 6 of product 3 in loading station 11, and fold said portion 18 on to product 3.

Figure 4:
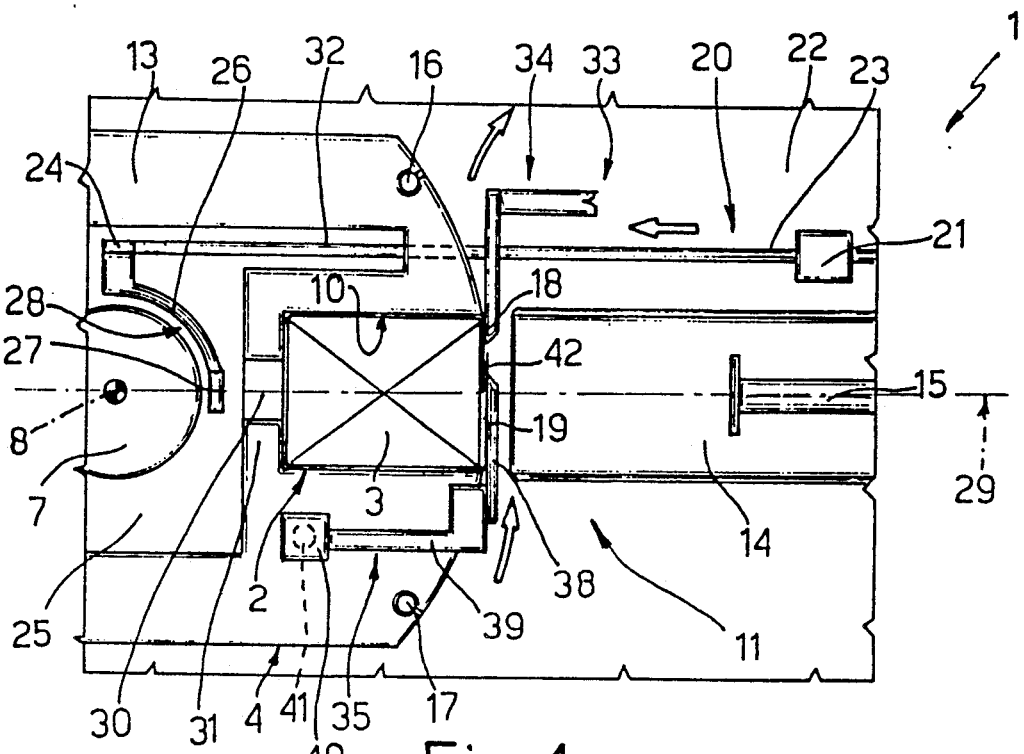

Each mobile folding device 35 comprises a folding plate 38 fitted squarely to the end of the output rod 39 of a linear actuator 40 supported on a respective powered shaft 41 parallel to axis 8 and connected for rotation to plate 13. Operation of shaft 41 and respective actuator 40 provides for moving plate 38, in relation to wheel 4, between a withdrawn idle position (FIG. 2) wherein plate 38 does not interfere with respective seat 10, and a forward operating position (FIG. 4) wherein plate 38 is located tangent to wheel 4, so as to engage portion 19 of sheet 6 of product 3 inside respective seat 10, and press portion 19 on to respective portion 18. As shown more clearly in FIG. 4, plate 38 is so sized as to leave an end portion 42 of portion 19 exposed in said forward operating position.

Unloading station 12 of device 1 comprises an unloading channel 43 supported, like channel 14, on plate 22, coplanar with plate 13, coaxial with axis 29, and having an input opening substantially tangent to the edge of wheel 4.

Unloading station 12 presents a pusher 44 which, when product 3 is arrested in unloading station 12, provides for pushing product 3 out of seat 10 and along channel 43 into engagement with a known folding device 45, which, in known manner, folds and secures the end portions of tubular wrapping 2 on to the respective end surfaces of product 3.

Pusher 44 comprises a linear actuator 46 supported in a fixed position on plate 22, to the side of channel 43, and located on the opposite side of channel 43 and wheel 4 in relation to plate 22. Actuator 46 presents an output rod 47 extending parallel to axis 29 and fitted squarely on its free end facing wheel 4 with an arm 48 extending parallel to plate 22 and perpendicularly intersecting axis 29. The free end of arm 48 is fitted integral with a crosspiece 49 substantially identical to crosspiece 27 and extending towards plate 22, parallel to axis 8.

Operation of actuator 46 provides for moving crosspiece 49, along axis 29 and through opening 30 in respective seat 10, between an extracted idle position (FIG. 5) wherein crosspiece 49 is located inside central passage 25, facing respective opening 30, and a withdrawn operating position (FIG. 1) wherein crosspiece 49, by moving through opening 30 and radially through seat 10, penetrates a given way inside channel 43.

Figure 5:
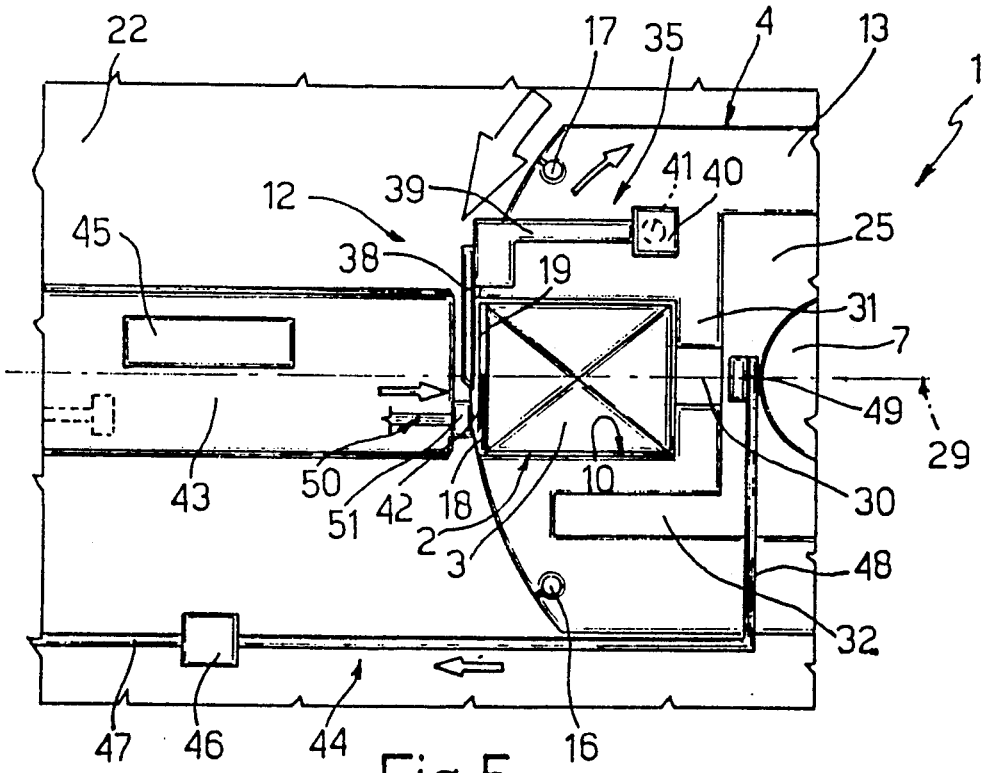

Finally, unloading station 12 comprises a counterpusher 50 moving along channel 43, parallel to axis 29, and cooperating with pusher 44, when unloading products 3, for permanently controlling the position of products 3 along channel 43. More specifically, as shown in FIG. 5, counterpusher 50 presents a head 51 designed to contact wrapping 2 of product 3 at end portion 42 of portion 19.

Should portions 18 and 19 be joined via the interposition of adhesive material, head 51, by pressing portion 42 of portion 19 on to underlying portion 18, provides for ensuring firm connection of portions 18 and 19, and is preferably heated for fully drying the adhesive material between portions 18 and 19.

In the event sheet 6 consists of heat-seal material, on the other hand, head 51 is defined by a heat-sealing device as described and illustrated in co-pending Italian Patent Application n.BO91A 000222 filed concurrently by the present Applicant and to which full reference is made herein in the interest of full disclosure.

In actual use, wrapping wheel 4 is rotated about axis 8 so as to arrest one of seats 10 in loading station 11, and, as it is rotated, cooperates with unit 5, which feeds a sheet 6 over the input opening of said seat 10.

Figure 2:
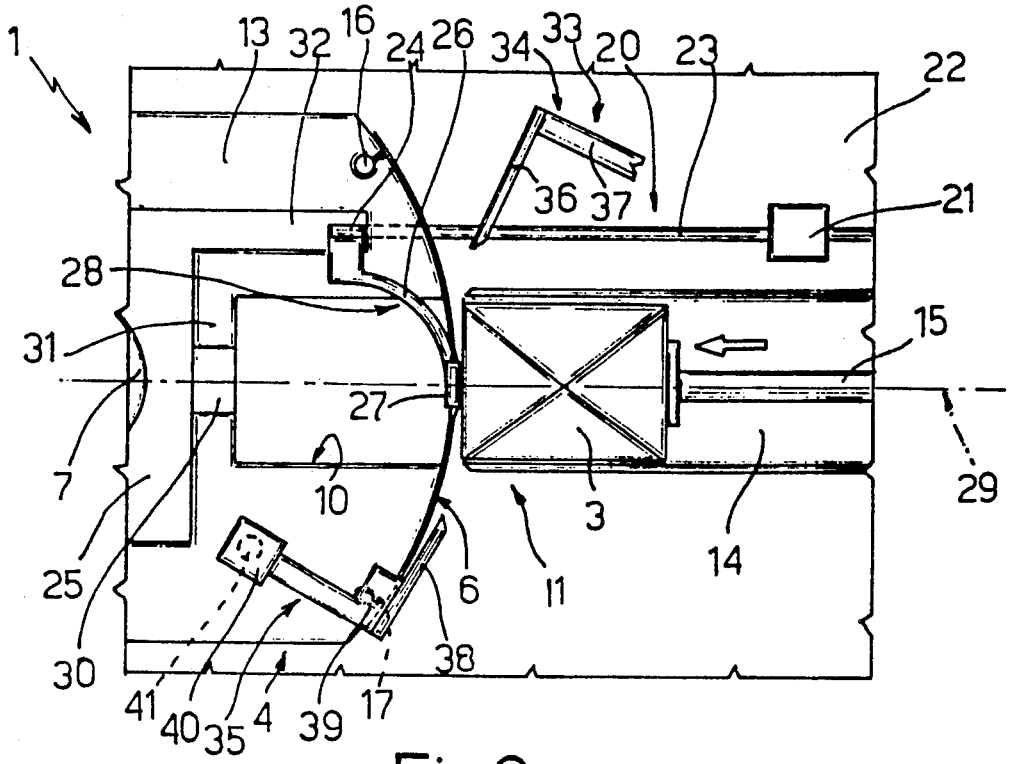
FIGS. 2 to 5 show partial schematic views of the FIG. 1 device in various operating positions.

As shown in FIG. 2, on seat 10 being arrested in loading station 11, counterpusher 20 is moved into the withdrawn operating position, while pusher 15 remains in the withdrawn idle position detached from the input opening of seat 10, and fixed folding device 34 and respective mobile folding device 35 remain in the idle position.

Figure 3:
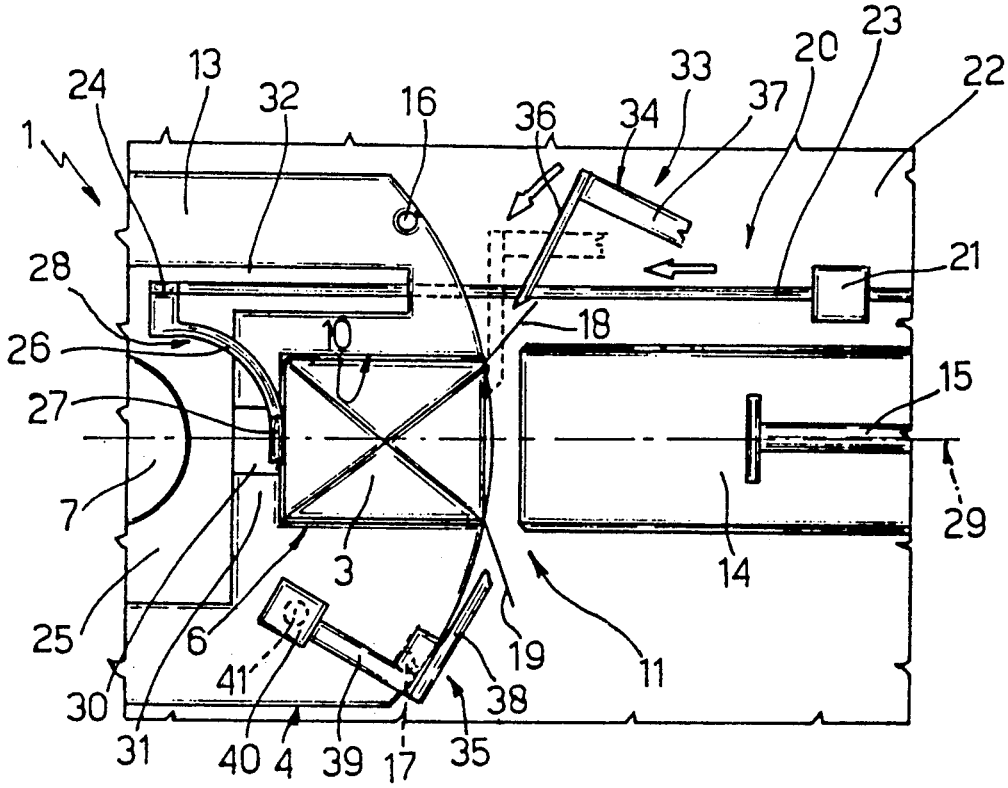

Subsequently, as product 3 is inserted (in known manner not shown) inside channel 14, between pusher 15 and counterpusher 20, pusher 15 is activated (FIG. 2) for moving product 3 into contact with sheet 6 and counterpusher 20, which, at this point, moves together with pusher 15 for inserting product 3 inside seat 10 and so folding sheet 6 in a U about product 3. As product 3 contacts end wall 31 of seat 10, pusher 15 is restored to the withdrawn idle position (FIG. 3), while counterpusher 20 continues through opening 30 so as to position crosspiece 27 in the extracted idle position inside passage 25.

Subsequently (FIGS. 3 and 4), fixed folding device 34 is moved into the operating position, so as to fold first portion 18, and is maintained in the operating position until mobile folding device 35 moves into the forward operating position, so as to fold second portion 19 on to first portion 18. More specifically, portion 19 is folded by operating actuator 40 to move rod 39 axially outwards, rotating shaft 41 (anticlockwise in FIG. 4) so as to bring the free end of plate 38 into contact with portion 19, and by further rotating shaft 41 and simultaneously operating actuator 40 to move rod 39 inwards, so that plate 38 presses portion 19 on to portion 18, thus completing tubular wrapping 2.

At this point, fixed folding device 34 is restored to the idle position, and wrapping wheel 4 is moved forward one step in direction 9 to arrest seat 10 in unloading station 12. As it does so, mobile folding device 35 is maintained in the forward operating position to hold portion 19 folded down on top of portion 18 and, at the same time, retain product 3 inside seat 10, thus eliminating the need for complex, high-cost devices on wheel 4 for retaining products 3 inside seats 10.

As product 3 is arrested in unloading station 12, counterpusher 50 (FIG. 5) is moved into the engaged position contacting end portion 42 of portion 19; mobile folding device 35 is restored to the idle position; and pusher 44 is moved from the extracted idle position into contact with product 3, and then, together with counterpusher 50, into the withdrawn operating position, so as to extract product 3 and tubular wrapping 2 from seat 10 (FIG. 1) and feed them along channel 43, past folding device 45, and into an unloading position (not shown) wherein product 3, now fully wrapped, is unloaded in known manner (not shown) from channel 43.

As already stated, as each product 3 is extracted from seat 10, counterpusher 50 provides for firmly connecting portions 18 and 19 at end portion 42 of portion 19, which end portion projects beyond the free end of plate 38 of mobile folding device 35 in the forward operating position.

I claim:

1. A product wrapping method for producing tubular wrappings (2), said method comprising stages consisting in operating a wrapping conveyor (4) having at least one outwardly-open wrapping seat (10) for a respective said product (3) in such a manner as to feed said seat (10) in a given direction (9) and along a path extending through a loading station (11) wherein said product (3) is loaded inside said seat (10), and through an unloading station (12) wherein said product (3) is unloaded from said seat (10); feeding a product wrapping element (6) in front of the input opening of said seat (10) at said loading station (11); feeding said product (3) inside said seat (10), so as to fold said wrapping element (6) in a U about said product (3), and so that a first and second longitudinal portion (18, 19) of said wrapping element (6) project outwards of said seat (10) through said inlet opening, said second longitudinal portion (19) being located upstream in relation to said first longitudinal portion (18) in said traveling direction (9); folding said portions (18, 19) one on top of the other into an overlapping position, and maintaining said portion (18, 19) in said overlapping position for a given length of time; characterized by the fact that said two portions (18, 19) are folded into said overlapping position by first folding said first portion (18) on to said product (3), and then folding said second portion (19) into said overlapping position on top of said first portion (18) by means of a folding device (35) fitted to said wrapping conveyor (4) and moving in relation to the same to and from an operating position wherein it contacts and exerts pressure on said second portion (19) in said overlapping position, wherein said folding device (35) is so formed as to leave the free longitudinal end portion (42) of said second portion (19) exposed in said operating position; wherein said said wrapping element (6) consists of heat sealable material; said two overlapping portions (18,19) being made integral with each other by heat-sealing said free longitudinal end portions (42) of said second portion (19) on to said first portion (18) via unloading means (50) at said unloading station (12), wherein said unloading means (50) comprises means to engage and effect the heating of said longitudinal end portion (42).

2. A method as claimed in claim 1, characterized by the fact that said folding device (35) is maintained in said operating position until said seat (10) reaches said unloading station (12).

3. A method as claimed in claim 1, characterized by the fact that the movement of said folding device (35) into said operating position presents first component substantially parallel to said traveling direction (9), and a second component substantially perpendicular to said traveling direction (9).

4. A method as claimed in claim 1, characterized by the fact that said first portion (18) is folded first on to said product (3) inside said seat (10) by a further folding device (34) at said loading station (11).

5. A product wrapping device (1) for producing tubular wrappings (2), said device (1) comprising a wrapping conveyor (4) having at least one outwardly-open wrapping seat (10) for a respective said product (3), and moving in a given direction (9) for feeding said seat (10) along a given path; a loading station (11) for loading said product (3) inside said seat (10), and an unloading station (12) for unloading said product (3) from said seat (10), both said stations (11, 12) being located along said path; means (5) for feeding a product wrapping element (6) in front of the input opening of said seat (10); first pushing means (15, 20) for inserting said wrapping element (6) and respective said product (3) inside said seat (10), so as to fold said wrapping element (6) in a U about said product (3), and so that a first and second longitudinal portion (18, 19) of said wrapping element (6) project outwards of said seat (10) through said input opening, said second longitudinal portion (19) being located upstream in relation to said first longitudinal portion (18) in said traveling direction (9); and folding means (33) for folding said portions (18, 19) one on top of the other into an overlapping position, and for maintaining said portions (18, 19) in said overlapping position for a given length of time; wherein said folding means (33) comprises a folding device (35) fitted to said wrapping conveyor (4) and moving in relation to the same to and from an operating position wherein it contacts and exerts pressure on said second portion (19) located outwards of said first portion (18) in said overlapping position, wherein said folding device (35) comprises plate means (38) designed to contact said second portion (19); said plate means (38) being so sized as to leave the free longitudinal end portion (42) of said second portion (19) exposed when said folding device (35) is in said operating position; said device further comprising joining means (51) for rendering said two overlapping portions (18, 19) integral with each other at said free longitudinal end portion (42) of said second portion (19) wherein said joining (51) are located at said unloading station (12), wherein said wrapping element (6) consists of heat-sealable material; said unloading station (12) comprising means (50) for unloading said products (3) and respective wrappings (2) from said seats (10); and said joining means (51) comprising a heat-sealing device engaging said overlapped portions and forming part of said means for unloading (50).

6. A device as claimed in claim 5, characterized by the fact that said joining means (51) comprise a heating element designed to engage said free longitudinal end portion (42) of said second portion (19) at said unloading station (12).

7. A device as claimed in claim 5, characterized by the fact that said folding device (35) comprises first actuating means (41) and second actuating means (40) for respectively imparting to said plate means (38), as they move into said operating position, a first component substantially parallel to said traveling direction (9), and a second component substantially perpendicular to said traveling direction (9).

8. A device as claimed in claim 5, characterized by the fact that it comprises a further folding device (34) for folding said first portion (18) on to said product (3) inside said seat (10); said further folding device (34) being fitted to said loading station (11).

* * * * *